US008387828B2

(12) United States Patent
Moothart

(10) Patent No.: US 8,387,828 B2
(45) Date of Patent: Mar. 5, 2013

(54) COOLING OR HEATING BEVERAGE DISPLAY DISPENSER

(76) Inventor: Martin Joseph Moothart, Tampa, FL (US)

( * ) Notice: Subject to any disclaimer, the term of this patent is extended or adjusted under 35 U.S.C. 154(b) by 1148 days.

(21) Appl. No.: 11/895,654

(22) Filed: Aug. 27, 2007

(65) Prior Publication Data

US 2009/0057340 A1 Mar. 5, 2009

(51) Int. Cl.
*B67D 7/78* (2010.01)

(52) U.S. Cl. ..... 222/130; 222/185.1; 222/113; 222/146.1

(58) Field of Classification Search ..... 222/113, 222/146.1, 192, 185.1, 130, 131, 183; 239/18, 239/102.2; 362/96, 101; 215/230
See application file for complete search history.

(56) References Cited

U.S. PATENT DOCUMENTS 755,723 A * 3/1904 Taydor ..... 62/396
869,551 A * 10/1907 Cole ..... 62/249
1,756,944 A * 5/1930 Gorton, Jr. ..... 40/306
4,818,843 A * 4/1989 Swiatosz ..... 392/397
4,834,250 A * 5/1989 Dumbeck et al. ..... 222/183
4,913,318 A * 4/1990 Forrester ..... 222/129
5,413,152 A * 5/1995 Burrows ..... 141/18
5,494,195 A * 2/1996 Knuettel et al. ..... 222/146.6
5,732,857 A * 3/1998 Yared ..... 222/185.1
5,890,629 A * 4/1999 Loew ..... 222/144.5
6,644,506 B2 * 11/2003 Erlandsen ..... 222/23
6,923,549 B2 * 8/2005 Hoy ..... 362/101
7,591,391 B2 * 9/2009 Nielsen ..... 220/556
2003/0071068 A1 * 4/2003 Burrows ..... 222/185.1
2003/0102330 A1 * 6/2003 Cote ..... 222/129.1
2003/0115781 A1 * 6/2003 Boutilier ..... 40/310
2003/0146241 A1 * 8/2003 Moothart et al. ..... 222/130
2005/0028550 A1 * 2/2005 Crettet, IV ..... 62/391
2006/0207679 A1 * 9/2006 Ross ..... 141/94
2007/0201220 A1 * 8/2007 Ulicny ..... 362/101
2008/0283438 A1 * 11/2008 Kotulla ..... 206/525
2010/0281909 A1 * 11/2010 Carpanzano ..... 62/386
2010/0288791 A1 * 11/2010 Myyrylainen et al. ..... 222/113

* cited by examiner

*Primary Examiner* — Kevin P Shaver
*Assistant Examiner* — Robert Nichols, II
(74) *Attorney, Agent, or Firm* — Ronald E. Smith; Smith & Hopen, P.A.

(57) ABSTRACT

A device for dispensing a beverage includes a main body. A first vertically-extending opening formed in the main body receives and displays a display bottle in an upright configuration. A second vertically-extending opening formed in the main body receives an inverted dispensing bottle. A dispensing tap spigot is in valved fluid communication with the inverted dispensing bottle. Opening the dispensing tap spigot enables liquid fluid within the inverted dispensing bottle to flow from the dispensing tap spigot under the influence of gravity and closing of the dispensing tap spigot terminates the flow. A thermoelectric temperature control member selectively generates cold or heat and is positioned in heat transfer relation to the inverted dispensing bottle. The main body is aesthetically designed to provide a connotation of coolness when a cooled beverage is to be dispensed and of heat when a heated beverage is to be dispensed.

13 Claims, 4 Drawing Sheets

COOLING OR HEATING BEVERAGE DISPLAY DISPENSER

FIELD OF THE INVENTION

This invention relates, generally, to portable table or countertop beverage dispensers. More particularly, it relates to beverage dispensers used for both display and dispensing of either cooled or heated beverages.

DESCRIPTION OF THE PRIOR ART

Many alcoholic and other beverages are cooled prior to consumption to enhance flavor. Many beverages are also best served warm or hot. The consumer, however, seldom sees the device that does the cooling or heating. With cold drinks, for example, the consumer might observe the beverage being removed from a refrigerator, or ice may be added to the drink to the detriment of the flavor. When sake is served, it is poured from a heated bottle but the consumer does not see the heating process In most cases, the consumer is unaware of the cooling or warming means because such means is not on display. The cooling or heating means is not on display because it is completely utilitarian and lacks aesthetic appeal.

If consumers were treated with an aesthetically-pleasing display of the cooling or heating means, it would increase consumption of the beverage. If the cooling or heating means were exceptionally pleasing to the eye, it would become a topic of conversation itself and attract more business.

Another drawback of prior art cooling or heating devices is that most of them lack temperature control means. If a beverage is cooled in a refrigerator or other cooling means, it is quite difficult to exercise complete control over the serving temperature thereof. Similarly, a beverage heated in a microwave or other heating means will eventually warm to a selected temperature but there is no carefully controlled means for exercising temperature control.

Accordingly, there is a need for an aesthetically-pleasing beverage dispenser for cooled and warmed drinks.

There is also a need for an aesthetically-pleasing beverage dispenser that includes a cooling means with a control means that enables a cooled beverage to be served at a precisely-controlled temperature.

An equal need is extant for an aesthetically-pleasing beverage dispenser that includes a heating means with a control means that enables a heated beverage to be served at a precisely-controlled temperature.

Piesch, in U.S. Pat. No. 93,001 entitled "Pitcher," discloses a device that keeps the contents of a pitcher cool by providing an ice chamber in which chunks of ice are maintained. Although the device is functional, much of the interior of the pitcher is dedicated to the ice so the remaining volume dedicated to the beverage is substantially reduced.

U.S. Pat. No. 1,771,186 to Mock discloses a serving element having double walls to provide insulation against heat transfer. The space between the walls is partially filled with water. The serving element is placed upside down in a freezer and the water turns to ice.

U.S. Pat. No. 4,624,395 to Baron discloses a method of pre-heating stored water with a thermoelectric heat pump, followed by mixing the heated water with a concentrate of condensed coffee bean mixture, thereby creating coffee. It thus differs from conventional coffee makers that mix hot water and coffee grounds during the dispensing process. The Baron device is large and not portable; it therefore is unsuitable for use as a table or countertop unit.

A beverage cooling device is disclosed in U.S. Pat. No. 6,370,884 to Kelada. The device cools water by thermoelectric cooling but may not be suitable for cooling beverages other than water. It is unsuitable for use in a table or countertop environment due to its large footprint.

None of the prior art dispensers have aesthetic appeal.

In view of the prior art taken as a whole at the time the present invention was made, it was not obvious to those of ordinary skill in the art how a beverage dispenser for cooled drinks with a temperature control means and a beverage dispenser for warmed drinks with a temperature control means could be provided with a size suitable for table or counter top display and with an aesthetically-pleasing, conversation-generating appearance.

SUMMARY OF THE INVENTION

The long-standing but heretofore unfulfilled need for an apparatus and method for cooling and heating beverages with an aesthetically-appealing display device is now met by a new, useful, and non-obvious invention.

The inventive structure includes a self-contained, aesthetically-pleasing beverage display device capable of cooling or heating and dispensing any beverage that is properly positioned within the display dispensing device.

The novel device divides the aesthetically-pleasing display function from the utilitarian cooling, heating, and dispensing functions. In other words, the novel display in a cooled beverage mode displays a bottle of a beverage that is served cool or cold in an aesthetically-pleasing display that carries with it the idea of cold. For example, the bottle may be mounted on what appears to be an iceberg. The bottle is displayed upright, not inverted. When a conventional tap is operated to dispense the beverage, the bottle on display is unaffected because no liquid is dispensed from it. Instead, the cooled beverage is dispensed from a substantially concealed inverted bottle of the same beverage.

Similarly, the novel display in a warmed beverage mode displays a bottle of a beverage that is served warm or hot in an aesthetically-pleasing display that carries with it the idea of heat. For example, the bottle may be mounted on what appears to be a volcano. The bottle is displayed upright, not inverted. When a conventional tap is operated to dispense the beverage, the bottle on display is unaffected because no liquid is dispensed from it. Instead, the heated beverage is dispensed from a substantially concealed inverted bottle of the same beverage.

In both cooling and heating modes, the utilitarian cooling and heating means and the temperature control means associated therewith are not visible to the consumer. However, the aesthetically-pleasing display informs the consumer that the beverage dispensed therefrom is either cooled or heated.

The aesthetically-pleasing effects, in addition to providing the appearance of an iceberg, a volcanic mountain, or other cold or hot symbols, may include LED (light-emitting diode) lighting, atomizer vaporized liquid misting effects, exterior aesthetic effects, and the like.

A primary object of the invention is to provide an aesthetically-pleasing dispenser for cooled or heated beverages.

Another object is to provide such a dispenser with a temperature control means so that beverages may be cooled or heated to a preselected temperature.

Another important object is to display a beverage intended for consumption at a low temperature in a setting that provides a connotation of cold and to display a beverage intended for consumption at an elevated temperature in a setting that provides a connotation of heat.

Still another object is to provide such dispenser in a portable structure suitable for use on a table or counter top.

Additional objects include the provision of a beverage dispenser that incorporates a gravity flow control valve dispensing tap spigot to eliminate spillage.

Still further objects include the provision of a beverage dispenser that includes attractive features such as LED lighting effects, atomizer vaporized fluid mist effects, and a display pedestal for highly effective product and or advertising display.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1A:
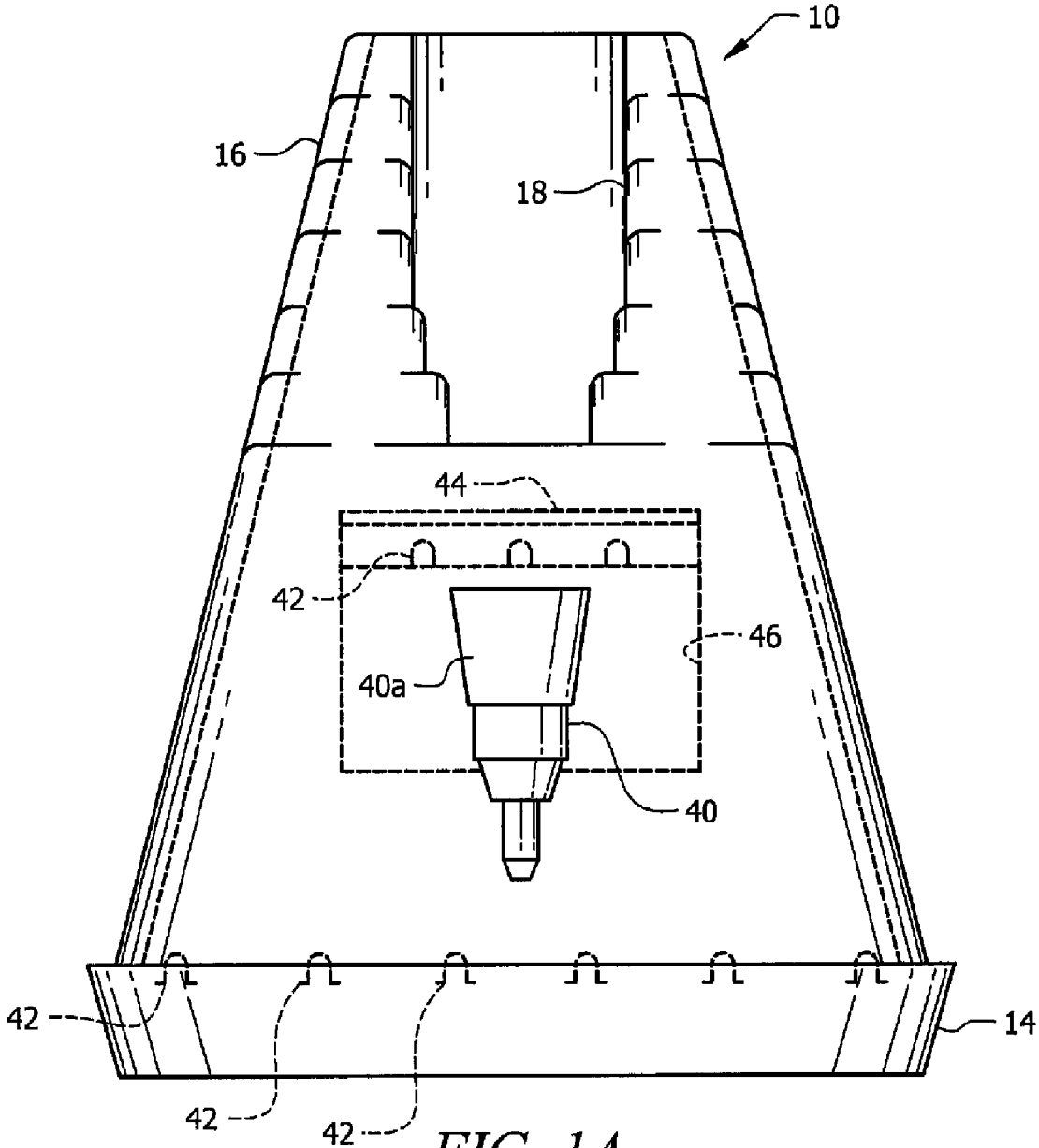
FIG. 1A is a front perspective view of the preferred embodiment.
Figure 1B:
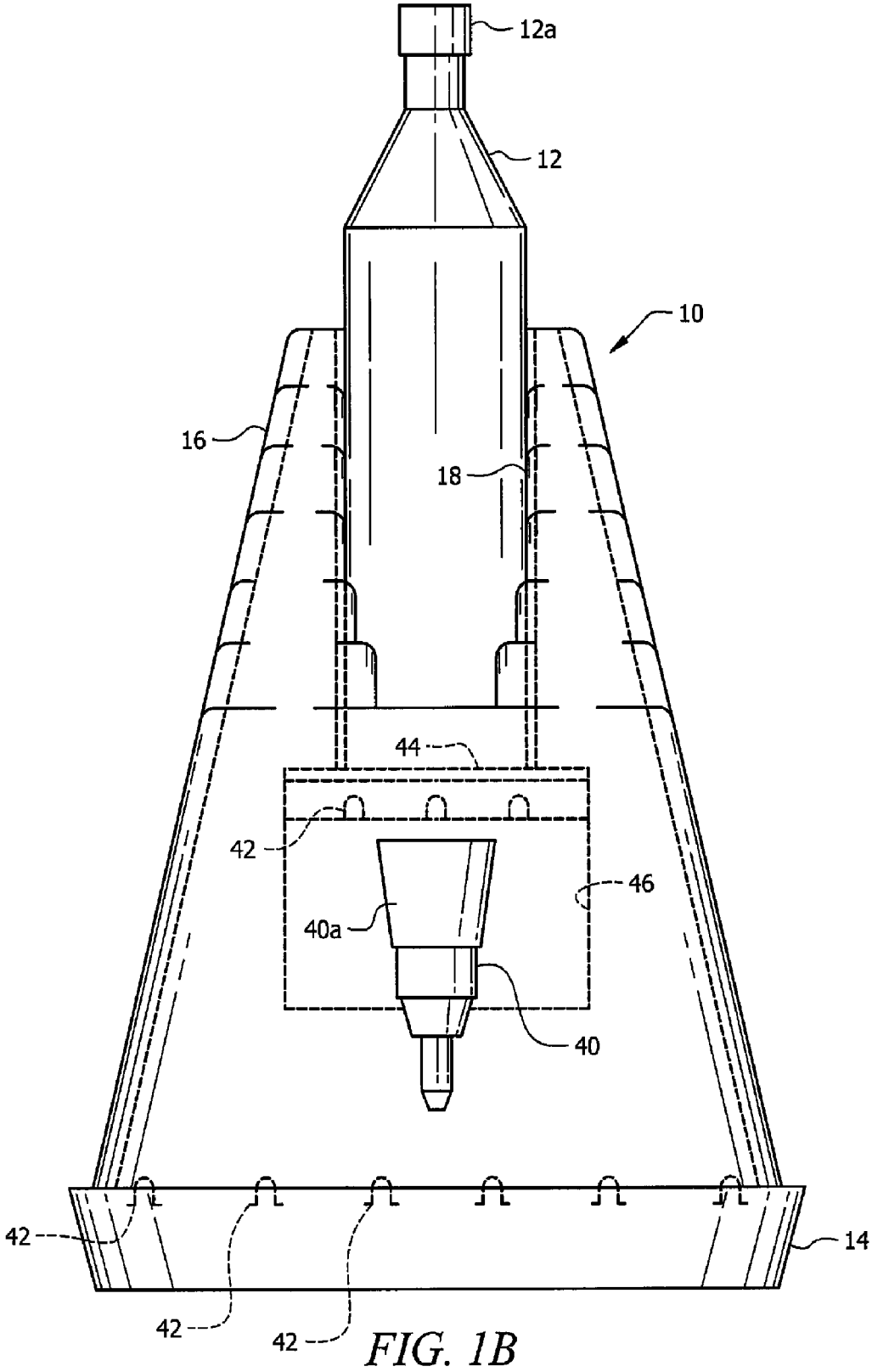
FIG. 1B is a front perspective view of the preferred embodiment when a display bottle is on display.

Referring now to FIGS. 1A and 1B, it will there be seen that a preferred embodiment of the invention is denoted as a whole by the reference numeral 10. FIG. 1A depicts novel device 10 when it is not in use, i.e., when it holds no display bottle and no dispensing bottle. FIG. 1B depicts novel device 10 when holding display bottle 12.

The novel structure includes base pedestal tray 14 and frusto-conical main body 16 that is supported by said base pedestal tray. Main body 16 is wider at its base than at its top as illustrated so that novel device 10 is highly stable and not easily knocked over even if bumped hard.

A first vertically-extending opening 18 is formed in main body 10. Said opening 18 has a diameter slightly greater than an external diameter of display bottle 12. As best understood by comparing FIGS. 1A and 1B, display bottle 12 is slideably received within opening 18 when novel device 10 is in use. The label of display bottle 12 should face forwardly for aesthetics and so that the contents of the bottle are known.

Figure 2:
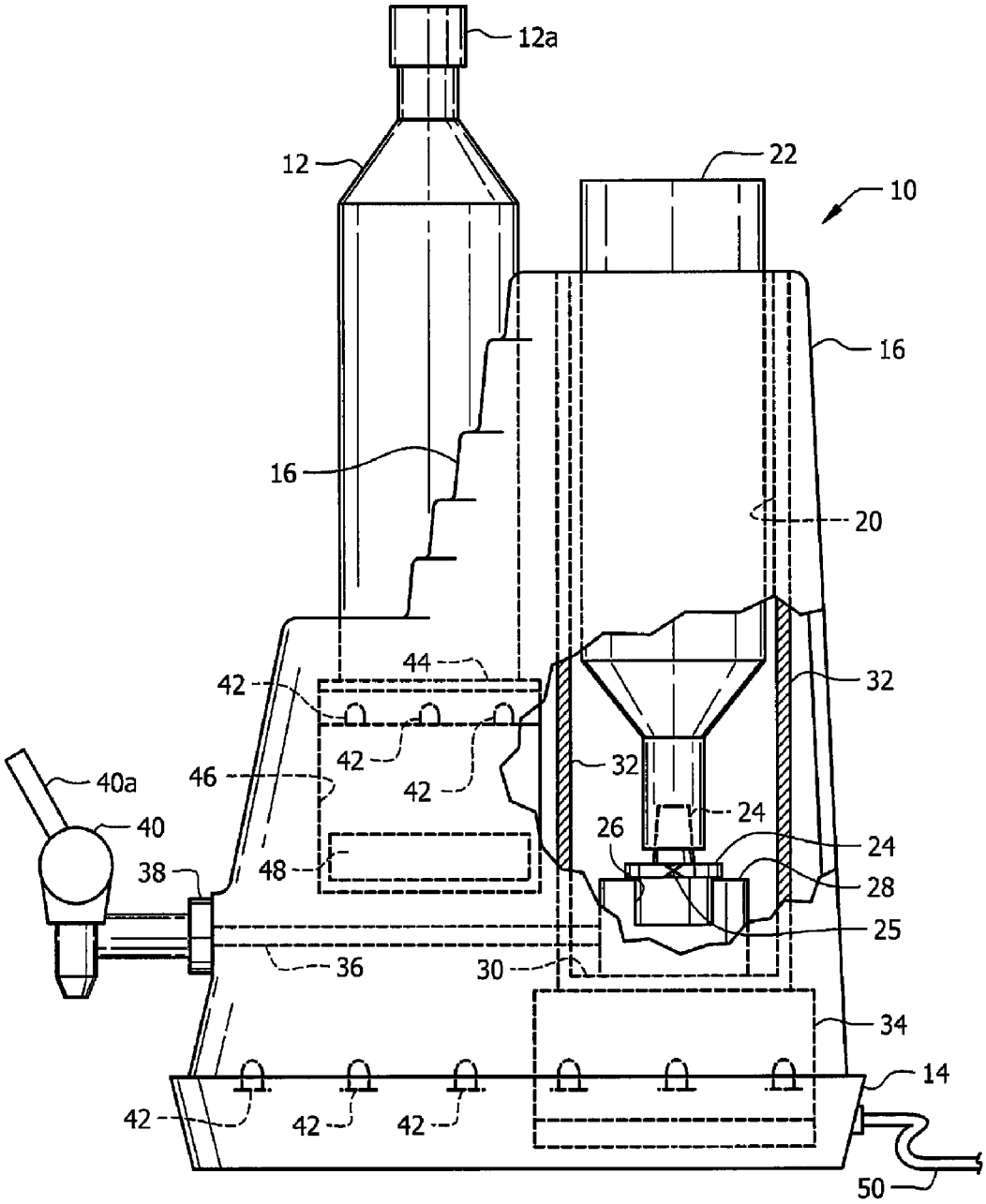
FIG. 2 is a side perspective view when both a display bottle and a dispensing bottle are in use.

As depicted in FIG. 2, a second vertically-extending opening 20 is also formed in main body 16, preferably directly behind first vertically-extending opening 18. Second opening 20 has a diameter slightly greater than an external diameter of dispensing bottle 22. Display bottle 12 and dispensing bottle 22 should contain the same liquid fluid contents because display bottle 12 represents to consumers that its contents will be dispensed when device 10 is operated even though nothing is dispensed from display bottle 12.

Note from the front elevational view of FIG. 1B that display bottle 12 conceals dispensing bottle 22 in a frontal view of said device. Note from the side elevational view of FIG. 2 and the rear elevational view of FIG. 3 that only a small part of dispensing bottle 22 is visible when device 10 is viewed from the side or rear.

As best understood in connection with FIG. 2, inverted dispensing bottle 22 is prepared for use by removing its conventional cap or stopper and replacing said conventional cap or stopper with novel bottle stopper 24 having a conventional air valve 25 formed therein. Conventional cap 12*a* remains on uninverted, upright display bottle 12 at all times.

Novel bottle stopper 24 is adapted to fit snugly within cavity 26 formed within bottle stopper reception unit 28.

Bottle stopper reception unit 28 is supported by bottom wall 30 of thermo conductive cooling/heating chamber 32 and chamber 32 is supported by thermoelectric cooling/heating means 34. Heat transfer from cooling/heating means 34 to cooling/heating chamber 32 is by conduction.

Dispensing bottle 22 is preferably in physical contact with cooling/heating chamber 32 although direct physical contact is not required. Heat transfer from cooling/heating chamber 32 to dispensing bottle 22 and its contents may take place by all three (3) methods of heat transfer, i.e., conduction, radiation and convection, or any combination thereof.

Since bottles do not have a standard size, the diameter of cooling/heating chamber 32 is made a little larger than the diameter of the bottle having the largest diameter. Bottles to be cooled or warmed may then be placed in a flexible gel cooling sleeve or a flexible gel warming sleeve so that they fit snugly within cooling/heating chamber 32. Heat transfer (whether cooling or heating) will then take place more efficiently.

When dispensing bottle 22 is in its operative, inverted configuration as depicted in FIG. 2, air valve 25 in bottle stopper 24 is in fluid communication with the lumen of dispensing tube 36. Dispensing tap securing cap 38 secures dispensing tap spigot 40 to main body 16 of device 10. Manipulation of handle 40*a* of dispensing tap spigot 40 in a well-known way brings a lumen formed within dispensing tap spigot 40 into fluid communication with the lumen of dispensing tube 36 and liquid fluid flows under the influence of gravity from dispensing bottle 22 through air valve 25 formed in bottle stopper 24, through the lumen of dispensing tube 36, and through the lumen within dispensing tap spigot 40 into a beverage glass. The flow of said liquid fluid is terminated in a well-known way by further manipulation of handle 40*a*.

A plurality of LED lights, collectively denoted 42, may be mounted about the periphery of base pedestal tray 14 as depicted in FIGS. 1A, 1B, and 2. Incandescent lights and other forms of lighting are also within the scope of this invention. The illumination provided by lights 42 is for aesthetic effect and various colors of lights may be selected. For example, white or blue lighting that illuminates frusto-conical main body 16 in white or blue is suitable if said main body is iceberg-shaped and display and dispensing bottles 12 and 22 are containers for beverages that are to be dispensed at a low temperature. Red or orange lights are more suitable when main body 16 is volcano-shaped. However any configuration of main body 16 and any color of lights consistent with the configuration is within the scope of this invention.

Display bottle 12 may also be individually illuminated by a plurality of lights, also collectively denoted 42 because they are preferably controlled by the same on/off switch as base pedestal lights 42 although separate circuits and switches are within the scope of this invention. Said lights are preferably positioned below display bottle support platform 44 in surrounding relation to said bottle, i.e., in circumferential relation to one another. Additional lights may be placed radially inwardly of the circumferentially spaced lights to more directly illuminate the interior of display bottle 12. Display bottle support platform 44 is therefore formed of a transparent or translucent material.

Hollow cavity 46 is a cup-like liquid containing compartment formed in main body 16 just below display bottle support platform 44. It holds liquid water and also accommodates display bottle lighting means 42 as depicted, said lighting means not being submerged in said liquid. It also provides a containment area for atomizer 48 that is submerged and that creates and emits a non-toxic vaporized fluid mist for aesthetic effect. The depicted atomizer has the appearance of a small hockey puck but it may be of any functional configuration. The coloring of the mist is determined by the color of lights 42. Thus, a white or blue mist might envelop display bottle 12 if a cooled beverage is to be dispensed by novel device 10 and a yellow, red, or orange mist might envelop said bottle if a heated beverage is to be dispensed. Purple, black, and mists of other colors are also within the scope of this invention.

Power is preferably supplied to thermoelectric cooling/heating means 34 by AC or DC power cord 50 but the use of batteries, power packs or other power sources is also within the scope of this invention.

In a basic embodiment of the invention, no lights 42 are provided to the aesthetic detriment of the device but power is still required to operate cooling/heating means 34.

This invention is not limited to cooling/heating means of the thermoelectric type. Any conventional cooling or heating means such as compressor refrigeration, heating elements, cooling or heating sleeves and the like may be used, for example. However, an important object of the invention is to employ a cooling or heating means whereby the final temperature is under the control of the user.

In an even more basic embodiment of novel device 10, neither lights 42 nor cooling/heating means 34 are provided. Such embodiment would be suitable for long term display and dispensing of beverages to be served at room temperature and in such event a misleading iceberg or volcano-like design would not be used. Such an embodiment could also be used for display and dispensing of a cooled or heated beverage that is cooled or heated in a conventional way unconnected to novel device 10 and then placed in said device for relatively rapid consumption.

Figure 3:
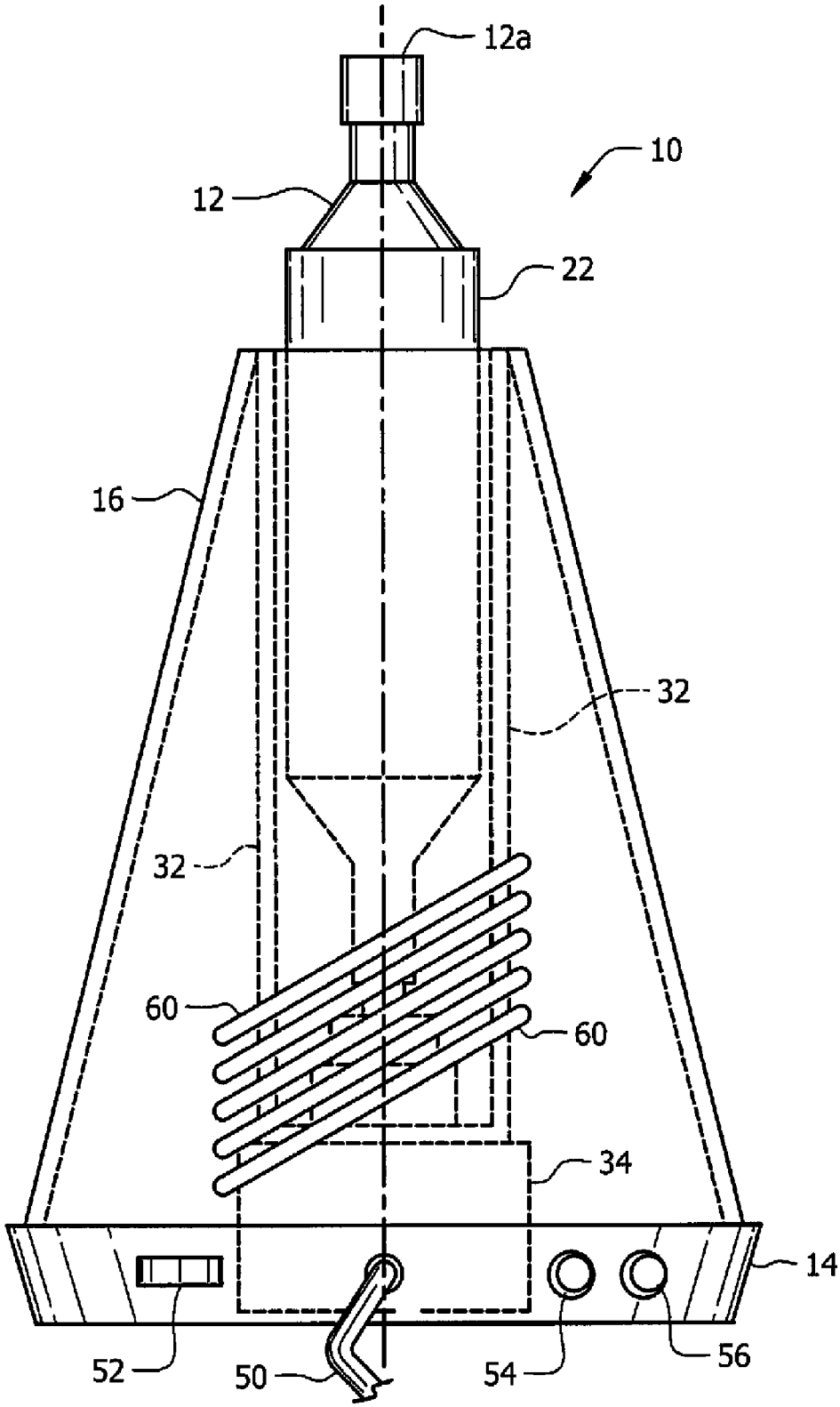
FIG. 3 is a rear elevational view when both a display bottle and a dispensing bottle are in use.

FIG. 3 depicts AC/DC power cord 50, thermo hot/cold switch 52, atomizer on/off switch 54, LED lighting on/off switch 56, and air circulation vents 60. Thermo cold/hot switch 52 also includes a neutral position where no power is delivered to the temperature control means 34. This enables the display and dispensing of a beverage that is neither cooled nor heated, i.e., served at room temperature. In a very basic embodiment of the invention, no temperature control means is provided and thus no switch 52 for controlling such non-existent temperature control means is provided. However, a preferred embodiment includes thermoelectric temperature control means 34 and switch 52 having three (3) positions for cooling, heating, or neutral.

Dispenser 10 may be formed of plastic, glass, metal, wood, or any other suitable material.

To use dispenser 10, an operator fills the reservoir of atomizer 48 with water or other non-toxic liquid fluid to the recommended capacity. The operator then plugs in the device. Next, the cap or stopper is removed from dispensing bottle 22 and said cap or stopper is replaced by novel bottle stopper 24 having air valve 25 formed therein. Dispensing bottle 22 is then inverted and inserted quickly but smoothly into bottle stopper reception unit 28 which is located within thermo conductive cooling/heating chamber 32.

The operator waits until thermoelectric cooling and or heating device 34 cools or heats inverted dispensing bottle 22 and its contents.

The operator positions a filled or empty display bottle 12 within vertically-extending cavity 18 so that it rests upon support platform 44. The display bottle must be a truthful representation of the substantially concealed dispensing bottle, i.e., the operator should not display a vodka bottle if a gin bottle is in the dispensing unit. Nor should a first brand of a beverage by displayed if a second brand of the same beverage is to be dispensed.

Dispenser 10 can be additionally aesthetically enhanced in many additional or alternative ways by various decorations including displays of corporate branding.

Dispenser 10 may be provided in any geometric configuration. For example, it may be shaped to resemble a mound of ice, an ice sculpture, a lava flow, a volcano, a palm tree, or any number of artistic configurations.

Dispenser 10 may be transparent, translucent, or opaque.

Moreover, it may be textured for function or aesthetics or non-textured. A lazy susan type of rotating platform mechanism could also be incorporated into base pedestal tray 14, thereby facilitating self-service by a larger numbers of users.

In an alternative embodiment, more than one inverted dispensing bottle could be provided to increase the capacity of the device and reduce the number of re-filling operations.

Still another alternative embodiment includes the addition of voice, music, or other sound effects, by means of conventional technology.

Another alternative embodiment includes a second cooling/heating chamber 32, a second cooling/heating means 34, or a second dispensing tap spigot 18 for the purpose of delivering multiple cooled or heated beverages independently or simultaneously. Any number of such chambers, cooling/heating devices, or spigots is within the scope of this invention.

The novel structure also provides increased sanitation of beverage storage and delivery, by virtue of the completely contained beverage chamber that allows dispensing of beverages in a more sanitary fashion than conventional pitchers and dispensers.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A device for dispensing a beverage, comprising:

a main body;

a first vertically-extending opening formed in said main body;

an uninverted, upright display bottle disposed in said first vertically-extending opening;

said first vertically-extending opening substantially revealing said uninverted, upright display bottle so that a user of said device may visually determine the liquid content of said uninverted, upright display bottle by observing a label on said uninverted, upright display bottle;

a second vertically-extending opening formed in said main body;

an inverted dispensing bottle disposed in said second vertically-extending opening;

a dispensing tap spigot in valved fluid communication with said inverted dispensing bottle;

said first vertically-extending opening being formed in said main body between said dispensing tap spigot and said second vertically-extending opening, said inverted dispensing bottle being substantially hidden from a user's view by said uninverted, upright display bottle and said main body when said user operates said dispensing tap spigot;

whereby opening of said dispensing tap spigot enables liquid fluid within said inverted dispensing bottle to flow from said dispensing tap spigot and closing of said dispensing tap spigot terminates said flow of liquid fluid; and whereby said label on said uninverted, upright display bottle reveals to said user the identity of the beverage dispensed from said dispensing tap spigot if the content of the dispensing bottle is revealed by the label of the uninverted, upright display bottle.

2. The device of claim 1, further comprising:

a temperature control means for selectively cooling or heating a hollow cavity.

3. The device of claim 2, further comprising:

a cooling/heating chamber positioned within said second vertically-extending opening in lining relation thereto;

said cooling/heating chamber being disposed in heat transfer relation to said temperature control means.

4. The device of claim 3, further comprising:

a bottle stopper having an air valve adapted to replace a conventional stopper for said dispenser bottle;

a bottle stopper reception unit that receives said bottle stopper having said air valve;

said bottle stopper reception unit being disposed in conductive heat transfer relation to said cooling/heating chamber;

said cooling/heating chamber receiving said inverted dispenser bottle;

whereby said inverted dispenser bottle is placed into fluid communication with said bottle stopper reception unit; and whereby said inverted dispenser bottle and its contents are cooled or warmed when said bottle stopper reception unit and said cooling/heating chamber are cooled or warmed by said temperature control means.

5. The device of claim 4, further comprising:

a dispensing tube providing fluid communication between said dispensing tap spigot and said bottle stopper reception unit;

whereby opening said dispensing tap spigot dispenses a cooled beverage when said temperature control means is in a cooling mode; and whereby opening said dispensing tap spigot dispenses a heated beverage when said temperature control means is in a heating mode.

6. The device of claim 2, further comprising:

a cooling/heating switch for controlling said temperature control means.

7. The device of claim 6, further comprising:

said cooling/heating switch including a neutral position where no power is delivered to said temperature control means.

8. The device of claim 1, further comprising:

a lighting means for illuminating said main body.

9. The device of claim 8, further comprising:

an on/off switch for controlling said lighting means.

10. The device of claim 1, further comprising:

a lighting means for illuminating said uninverted, upright display bottle.

11. The device of claim 10, further comprising:

an on/off switch for controlling said lighting means.

12. The device of claim 1, further comprising:

an atomizer for generating and emitting a non-toxic vaporized fluid mist that envelopes said uninverted, upright display bottle for aesthetic effect.

13. The device of claim 12, further comprising:

an on/off switch for controlling said atomizer.

* * * * *